US007877828B2

(12) United States Patent
Bzorgi

(10) Patent No.: US 7,877,828 B2
(45) Date of Patent: Feb. 1, 2011

(54) PORTABLE, SPACE-SAVING MEDICAL PATIENT SUPPORT SYSTEM

(75) Inventor: Fariborz Bzorgi, Knoxville, TN (US)

(73) Assignee: Babcock & Wilcox Technical Services Y-12, LLC, Oak Ridge, TN (US)

( * ) Notice: Subject to any disclaimer, the term of this patent is extended or adjusted under 35 U.S.C. 154(b) by 819 days.

(21) Appl. No.: 11/689,217

(22) Filed: Mar. 21, 2007

(65) Prior Publication Data

US 2008/0229503 A1 Sep. 25, 2008

(51) Int. Cl.
*A61G 7/008* (2006.01)
*A61G 7/012* (2006.01)
*A61G 7/08* (2006.01)

(52) U.S. Cl. ..... 5/627; 5/620; 5/611; 5/607

(58) Field of Classification Search ..... 5/627, 5/625, 620, 629, 611, 11, 600, 607, 414, 5/507.1

See application file for complete search history.

(56) References Cited

U.S. PATENT DOCUMENTS

| | | | | | |
|---|---|---|---|---|---|
| 346,246 | A * | 7/1886 | Uhde | 5/611 |
| 2,833,587 | A * | 5/1958 | Saunders | 296/20 |
| 3,121,881 | A * | 2/1964 | Schnell | 5/629 |
| 3,644,944 | A | 2/1972 | Bourgraf et al. | |
| 3,905,054 | A * | 9/1975 | Windsor et al. | 5/86.1 |
| 4,078,269 | A * | 3/1978 | Weipert | 5/611 |
| 4,190,280 | A | 2/1980 | Donohoe | |
| 4,860,394 | A * | 8/1989 | Benessis et al. | 5/611 |
| 5,299,334 | A * | 4/1994 | Gonzalez | 5/607 |
| 5,435,027 | A * | 7/1995 | Bourgraf et al. | 5/611 |
| 5,490,703 | A | 2/1996 | Hewko | |
| 6,076,206 | A | 6/2000 | Celaya | |
| 6,155,260 | A * | 12/2000 | Lavin et al. | 128/845 |
| 6,766,547 | B1 | 7/2004 | Lagassey | |
| 2003/0115671 | A1 | 6/2003 | Smeed | |
| 2004/0094999 | A1 | 5/2004 | Volotsenko | |
| 2006/0137095 | A1 | 6/2006 | Schaefer | |
| 2008/0229503 | A1 * | 9/2008 | Bzorgi | 5/620 |

FOREIGN PATENT DOCUMENTS

| | | |
|---|---|---|
| DE | 20015637 | 11/2000 |
| GB | 435504 | 9/1935 |

* cited by examiner

*Primary Examiner*—Robert G Santos
(74) *Attorney, Agent, or Firm*—Michael J. Renner; Luedeka, Neely & Graham PC

(57) ABSTRACT

A support platform having a stowed configuration and a deployed configuration on a floor. The support platform is related to stretcher devices that are used for transporting, confining, or conducting medical procedures on medical patients in medical emergencies. The support platform typically includes a work surface that has a geometric extent. A base that typically includes a plurality of frame members is provided, and the frame members are disposed across the geometric extent of, and proximal to, the work surface in the stowed configuration. The frame members are typically disposed on the floor in the deployed configuration. There is a foldable bracing system engaged with the work surface and engaged with the base. At least a portion of the foldable bracing system is disposed substantially inside at least a portion of the plurality of frame members in the stowed configuration. Further, the foldable bracing system is configured for translocation of the work surface distal from the base in the deployed configuration.

12 Claims, 6 Drawing Sheets

PORTABLE, SPACE-SAVING MEDICAL PATIENT SUPPORT SYSTEM

GOVERNMENT RIGHTS

The U.S. Government has rights to this invention pursuant to contract number DE-AC05-00OR22800 between the U.S. Department of Energy and BWXT Y-12, L.L.C.

FIELD

This invention relates to the field of medical furniture stored for exigent applications. More particularly, this invention relates to stretcher devices stored for transporting, confining, or conducting medical procedures on medical patients in medical emergencies.

BACKGROUND

Various forms of stretchers and gurneys have been developed to transport persons for medical attention. A stretcher is a device typically having a canvas sheet stretched between two parallel longitudinal poles, and is typically carried by two persons, one person at each end of the stretcher, each holding the ends of the poles. "Gurney" is a term that is typically used to refer to a transporting device having a bed-like structure supported on a frame having wheels. Some emergency medical teams maintain a stockpile of stretchers for potential use in transporting casualties in a medical emergency involving a large number of casualties. However, because a stretcher is typically designed to rest near the ground it generally does not facilitate medical treatment of the patient it bears. Gurneys are typically too bulky and expensive to stockpile for medical emergencies. What is needed therefore is an inexpensive, compact, easily transportable medical platform that is easy to store and deploy and that accommodates medical treatment of patients.

SUMMARY

The present invention provides in one embodiment, a support platform that is operable to be configured in a stowed configuration and a deployed configuration on a floor. The support platform has a work surface and a base that has a plurality of frame members that are disposed proximal to the work surface in the stowed configuration and that are disposed distal from the work surface in the deployed configuration. The support platform also includes a foldable bracing system having a plurality of braces, each brace being engaged with the work surface and engaged with the base. At least a portion of at least one brace is disposed inside at least a portion of one of the frame members in the stowed configuration. The foldable bracing system is further configured for translocating the work surface in transitioning between the stowed and deployed configurations and configured for supporting the work surface at a position distal from the base in the deployed configuration.

A further embodiment provides a support platform that is operable to be configured in a stowed configuration and a deployed configuration on a floor. The support platform has a work surface and a base. There is an access platform that is engaged with the base, and a bracing system that is engaged with the work surface and engaged with the base for translocation of the work surface to a position proximal to the base in the stowed configuration and for translocation of the work surface to a position distal from the base in the deployed configuration.

A still further embodiment provides a support platform that is operable to be configured in a stowed configuration and a deployed configuration on a floor. The support platform has a work surface and a base. There is a bracing system that is engaged with the work surface and engaged with the base for translocation of the work surface to a position proximal to the base in the stowed configuration and for translocation of the work surface to a position distal from the base in the deployed configuration. The bracing system is configured to dispose the work surface in an orientation that is laterally inclined relative to the floor in the deployed configuration.

BRIEF DESCRIPTION OF THE DRAWINGS

Various advantages are apparent by reference to the detailed description in conjunction with the figures, wherein elements are not to scale so as to more clearly show the details, wherein like reference numbers indicate like elements throughout the several views, and wherein.

DETAILED DESCRIPTION

In the following detailed description of the preferred embodiments, reference is made to the accompanying drawings, which form a part hereof, and within which are shown by way of illustration various specific embodiments of support platforms. It is to be understood that other embodiments may be utilized, and that structural changes may be made and processes may vary in other embodiments.

Figure 1:
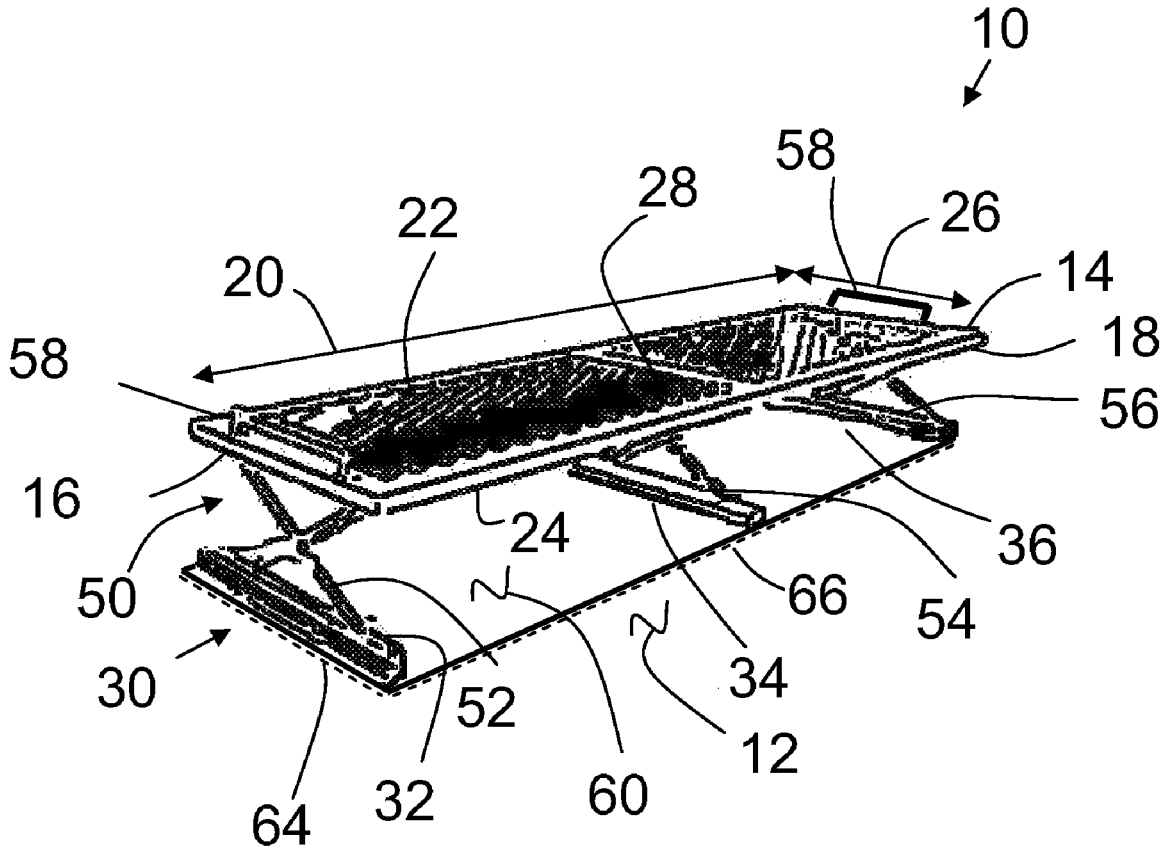
FIG. 1 is a somewhat schematic perspective view of an embodiment of a medical patient support system in a deployed configuration.
Figure 2:
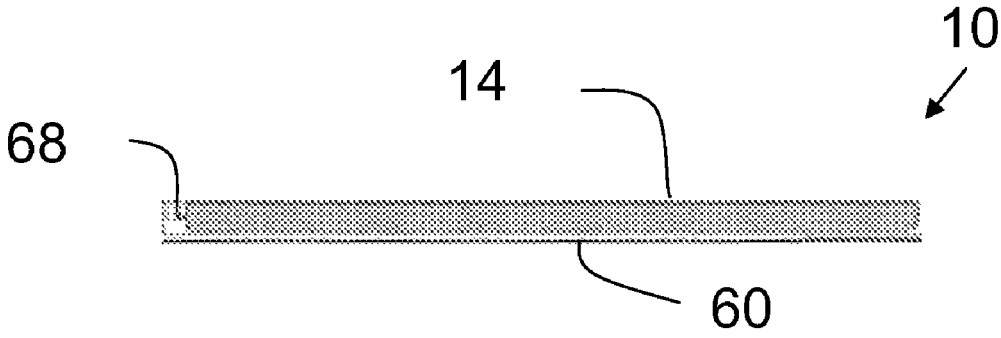
FIG. 2 is a somewhat schematic end view of the medical patient support system of FIG. 1, shown in a stowed configuration.

A medical patient support system 10 is illustrated in FIG. 1 and FIG. 2. The medical patient support system 10 is an example of a support platform. The medical patient support system 10 is depicted in a deployed configuration on a floor 12 in FIG. 1, and depicted in a stowed configuration in FIG. 2. The medical patient support system 10 is configured to be conveniently stacked and stored with other medical patient support systems 10 in the stowed configuration. When needed, the medical patient support system 10 is opened to the deployed configuration, typically for use in medical emergency situations that may involve mass casualties. The medical patient support system 10 may be configured for use side-by-side with other medical patient support systems 10 in transportation vehicles, such as semi-trailers, airplanes, ships, train cars, buses, etc. that may not be designed for mass casualty evacuations, but that could be used in emergencies for such purpose. The medical patient support system 10 may also be used in facilities such as armories, malls, schools, or athletic arenas. The medical patient support system 10 may also be used in temporary structures such as tents, in which case the floor 12 may be a grass or dirt surface.

FIG. 1 illustrates that the medical patient support system 10 includes a work surface 14. Typically the work surface 14 is constructed of sheet metal, but materials such as wood or plastic (such as blow-molded plastic) may also be used in the construction of the work surface 14. As illustrated in the embodiment of FIG. 1, the work surface 14 may be perforated to reduce weight. In many embodiments the work surface 14 is substantially rigid, meaning that it does not fold or roll up and has substantially the same shape when the medical patient support system is in the stowed configuration and in the deployed configuration. Stiffeners may be used to improve the rigidity of the work surface 14. The work surface 14 has a first end 16 and a second end 18 that define a longitudinal extent 20. The work surface 14 has a first side 22 and a second side 24 that define a lateral extent 26. When the work surface 14 is parallel to the floor 12 (as illustrated in FIG. 1) the longitudinal extent 20 and the lateral extent 26 define a "horizontal" reference plane for the work surface 14. The longitudinal extent 20 and the lateral extent 26 are examples of a "geometric extent." A center point 28 is disposed substantially midway along the longitudinal extent 20 and midway along the lateral extent 26 defining a bisection of the longitudinal extent 20 and a bisection of the lateral extent 26.

The medical patient support system 10 has a base 30 that includes a first lateral frame member 32, a second lateral frame member 34 and a third lateral frame member 36. The lateral frame members 32, 34, and 36 are disposed across the longitudinal extent 20 of the work surface 14, meaning that at least one of the lateral frame members 32, 34, and 36 is disposed on each side of the bisection of the longitudinal extent 20. Typically the lateral frame members 32, 34, and 36 are constructed of U-channel or angle-shaped metal structures.

In a preferred embodiment, the medical patient support system 10 has a foldable bracing system 50 that includes a first brace 52, a second brace 54 and a third brace 56. The braces 52, 54, and 56 may be formed as "X-members" as shown in FIG. 1, or in alternative embodiments the braces may be formed in other configurations such as telescoping members or jack-screw members. In some embodiments, more or fewer than three braces may be incorporated in the foldable bracing system 50. The foldable bracing system 50 is engaged with the work surface 14 and is engaged with the base 30. As used herein, the term "engaged with" (or variations thereof such as "in engagement with") refers to an arrangement of the recited elements that permits either static connection between or kinetic interaction between the recited elements, either by direct attachment of the elements together or by connection of the recited elements through one or more intervening elements. A "static connection" refers to an arrangement where one, two or more recited elements do not move to any significant extent with respect to each other. "Kinetic interaction" refers to an arrangement where one recited element may move with respect to at least a second recited element with such movement controlled by the interconnection of the recited elements and, if applicable, any intervening elements.

The foldable bracing system 50 is configured for translocation of the work surface 14 to a position distal from the base 30 when the medical patient support system 10 is in the deployed configuration as illustrated in FIG. 1. The foldable bracing system 50 is configured for translocation of the work surface 14 to a position proximal to the base 30 when the medical patient support system 10 is in the stowed configuration as illustrated in FIG. 2. The translocation of the work surface 14 is typically accomplished manually. However, in some embodiments the foldable bracing system 50 may be engaged with a power unit provided to assist in the translocation. Folding arms 58 (FIG. 1) may be lifted from the work surface 14 and used to help raise the work surface 14 from the stowed configuration to the deployed configuration.

In the embodiment of FIGS. 1 and 2 the base 30 includes a rectangular base plate 60 to which the lateral frame members 32, 34, and 36 are attached. Some embodiments do not include the rectangular base plate 60. The rectangular base plate 60 may be perforated to reduce weight. The "borders" of a base (e.g., the base 30) are defied as the sides of the smallest rectangle (which can be drawn on the floor 12) which includes within the sides of the rectangle all of the elements of the base that rest on the floor 12. For example, the base 30 includes borders 64 and 66 that are defined by the edges of the rectangular base plate 60. An alternative embodiment may be equivalent to the embodiment of FIGS. 1 and 2 except that the alternative embodiment excludes the rectangular base plate 60. The borders of the base of this alternative embodiment would still have two borders equivalent to borders 64 and 66. That is because those borders also represent the sides of the smallest rectangle (which can be drawn on the floor 12) that includes all of the elements of the base that rest on the floor (i.e., that includes the lateral frame members 32, 34, and 36).

In the embodiment of FIGS. 1 and 2, when the medical patient support system 10 is in the stowed configuration (as shown in FIG. 2), there are recessions in the underside of the work surface 14 that are configured to envelop the lateral frame members 32, 34, and 36. Furthermore, when the medical patient support system is in the stowed configuration (as shown in FIG. 2), preferably at least a portion of the first brace 52 is disposed inside the first lateral frame member 32, preferably at least a portion of the second brace 54 is disposed inside the second lateral frame member 34, and preferably at least a portion of the third brace 56 is disposed inside the third lateral frame member 36. As used herein the term "disposed inside," in reference to the configuration of a brace (e.g., 52) and a lateral frame member (e.g., 32), means that the elevation (with respect to the floor) of at least a portion of the brace (e.g., 52) is below the elevation (with respect to the floor) of at least a portion of the lateral frame member (e.g., 32). In some embodiments substantially all of the brace (e.g., 52) is below the elevation of at least a portion of the lateral frame member (e.g., 32), when the medical patient support system 10 is in the stowed configuration as shown in FIG. 2. This combination of (a) the recessions in the work surface 14 configured to envelop the lateral frame members 32, 34, and 36 and (b) the disposition of portions of the braces 52, 54, and 56 inside the lateral frame members 32, 34, and 36, permits the work surface 14 to rest proximal to the rectangular base plate 60 when the medical patient support system 10 is in the stowed configuration (as shown in FIG. 2). A suitable latching mechanism 68 (FIG. 2) is preferably provided as part of the foldable bracing system 50 to secure and release the foldable bracing system 50 between the deployed configuration and the stowed configuration.

In some embodiments the medical patient support system may be configured to fit into a recess in a deck, a wall, or a ceiling. The deck may be the floor where the medical patient support system is deployed or the deck may be a floor in a separate structure. For example, the medical patient support system in its stowed configuration may be installed as a floor panel in a transportation vehicle, such that little or no extra space is consumed by the medical patient support system during normal use of the vehicle. The medical patient support system could also be installed as a floor, wall or ceiling panel in a facility such as a hospital that might be expected to receive a large influx of patients resulting from a natural or human-caused disaster. When used as a floor panel, the medical patient support system is designed to have sufficient structural integrity to support the weight of personnel or materiel being transported in the vehicle. Compliance with the military surgical flooring standard of 65 lb/sf uniform distributed load is preferred. For deployment, the medical patient support system is raised, typically by raising and lifting folding arms (58 in FIG. 1), to dispose the medical patient support system in its deployed configuration. In alternate embodiments a medical patient support system may be configured to fit into a recess in a wall or ceiling. In such configurations the medical patient support system strength requirements are generally less than when the medical patient support system is used as a floor panel because, typically, the wall or ceiling must independently have sufficient strength to maintain its structural integrity after the medical patient support system is removed from the wall or ceiling for its deployment on a floor.

Figure 3:
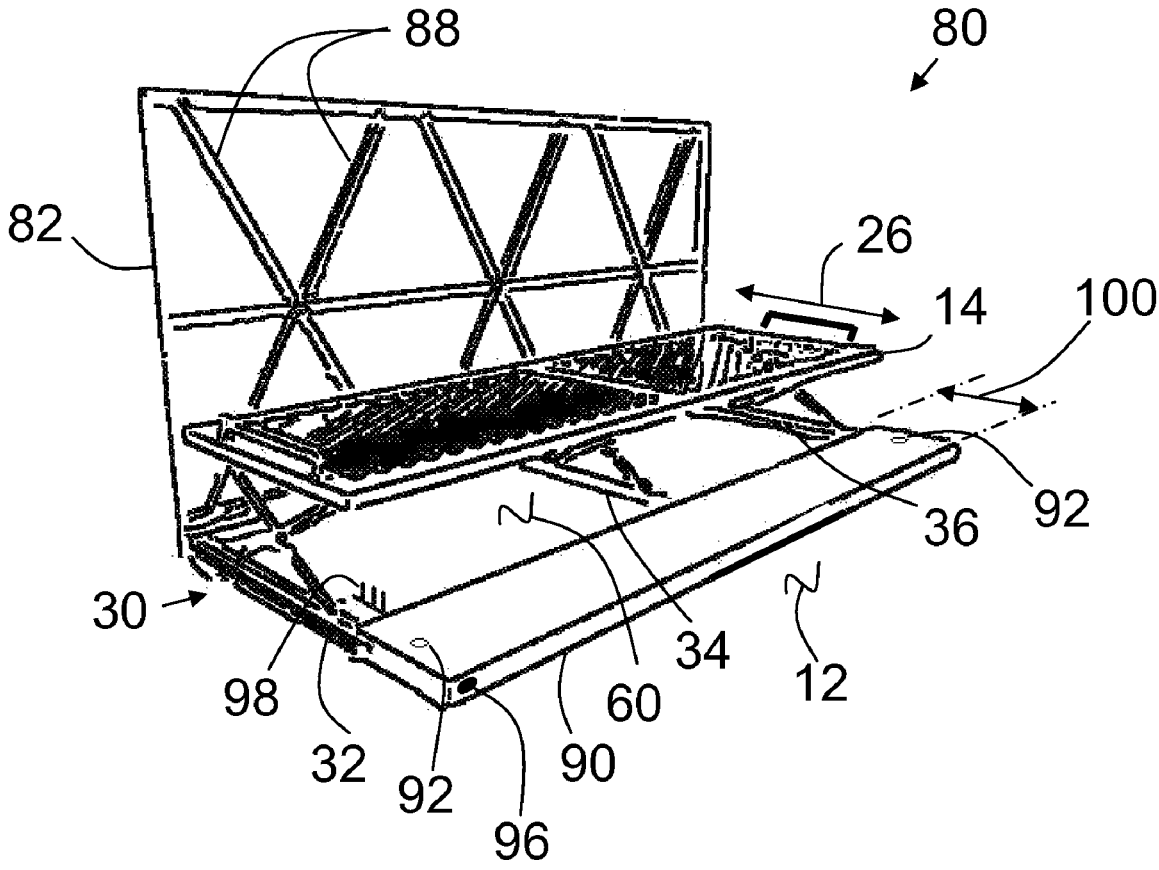
FIG. 3 is a somewhat schematic perspective view of an alternate embodiment of a medical patient support system in a deployed configuration.
Figure 4:
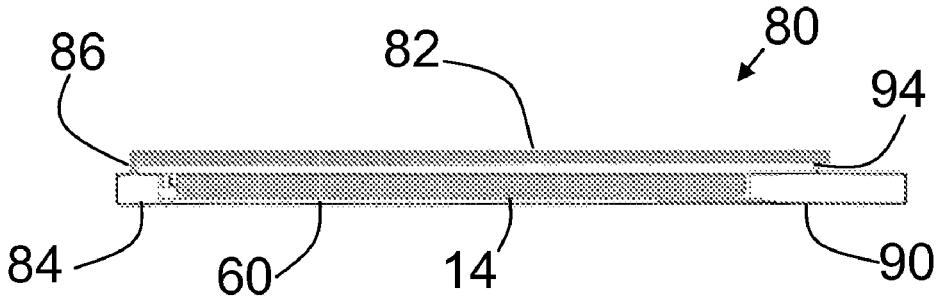
FIG. 4 is a somewhat schematic end view of the medical patient support system of FIG. 3, shown in a stowed configuration.

FIGS. 3 through 6 illustrate an alternative embodiment of a medical patient support system 80. Like the system 10, the medical patient support system 80 is an example of a support platform. The medical patient support system 80 is shown in a deployed configuration in FIG. 3 and in a stowed configuration in FIG. 4. The medical patient support system 80 includes a cover 82. In FIG. 3 the cover 82 is configured to form a wall that is substantially perpendicular to the floor 12, creating a privacy screen between adjacent medical patient support systems 80 when several medical patient support systems 80 are set up together. As illustrated in FIG. 4, the cover 82 is engaged with a longitudinal frame member 84 by a hinge 86. Generally the longitudinal frame member 84 is further engaged with the lateral frame members 32, 34, 36 (shown in FIG. 3) and the base plate 60. As illustrated in FIG. 4, the cover 82 may be disposed over the work surface 14 when the medical patient support system 80 is in the stowed configuration. Typically the cover 82 is constructed of sheet metal, but materials such as wood or plastic (such as blow-molded plastic) may also be used in the construction of the cover 82. The cover 82 may be reinforced using ribs 88 (as shown in FIG. 3). Other stiffeners such as honeycomb material may also be used to enhance the rigidity of the cover 82.

FIG. 3 further illustrates an access platform 90 engaged with the base 30. The access platform 90 is disposed along one border (visible as the border 66 in FIG. 1) of the base 30. As defined herein, an access platform is a ledge that rests on the floor and that, in the deployed configuration of a medical patient support system, extends horizontally beyond either the lateral or the longitudinal extent of the work surface, or extends beyond both the lateral and the longitudinal extent of the work surface. In the embodiment of FIG. 3 the access platform 90 extends horizontally beyond the lateral extent 26 of the work surface 14.

Locking receptacles 92 (FIG. 3) may be provided in the access platform 90 together with locking pins 94 (FIG. 4) in the cover 82 to secure the cover 82 to the access platform 90 when the medical patient support system 80 is in the stowed configuration. A medical service utility bus 96 may be provided to service a medical service utility manifold 98. In the embodiments of FIGS. 3-6, the medical utility service bus 96 includes an oxygen line, a vacuum line, and an electrical line. In this embodiment the medical utility service bus 96 may run through the lateral support 32 in a configuration such that when multiple medical patient support systems 80 are disposed adjacent to (side-by-side) each other, each medical utility service bus 96 is interconnected with the medical utility service bus 96 in the adjoining medical patient support system(s) 80. In the embodiment of FIG. 3, the access platform 90 includes a conduit to feed oxygen, vacuum, and electrical services from the medical utility service bus 96 to a medical service utility manifold 98. In embodiments not employing the access platform 90, the medical service utility manifold 98 connects directly to the medical utility service bus 96, which (as previously indicated) may be configured to pass through the lateral support 32. While in the embodiment of FIG. 3 the medical utility service bus 96 and the medical service utility manifold 98 provide an oxygen line, a vacuum line, and an electrical line, in alternative embodiments only one or two of those services, or similar alternative services may be provided.

The access platform 90 has a width 100. In some embodiments the width 100 of the access platform 90 is on the order of two inches. However in most embodiments the width 100 of the access platform is at least six inches and may be on the order of one foot. A width 100 of at least six inches is beneficial because it provides at least a minimal amount of space for a person to walk on the access platform 90 and pass between adjacent medical patient support systems when they are disposed side-by-side.

Figure 5:
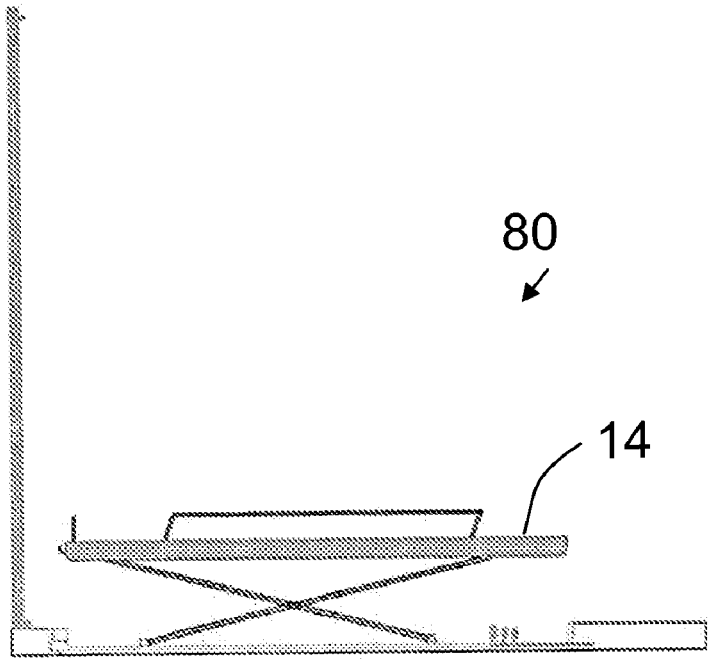
FIG. 5 is a somewhat schematic end view of the medical patient support system of FIG. 3, shown at a first stage of transition from a stowed configuration to a deployed configuration.
Figure 6:
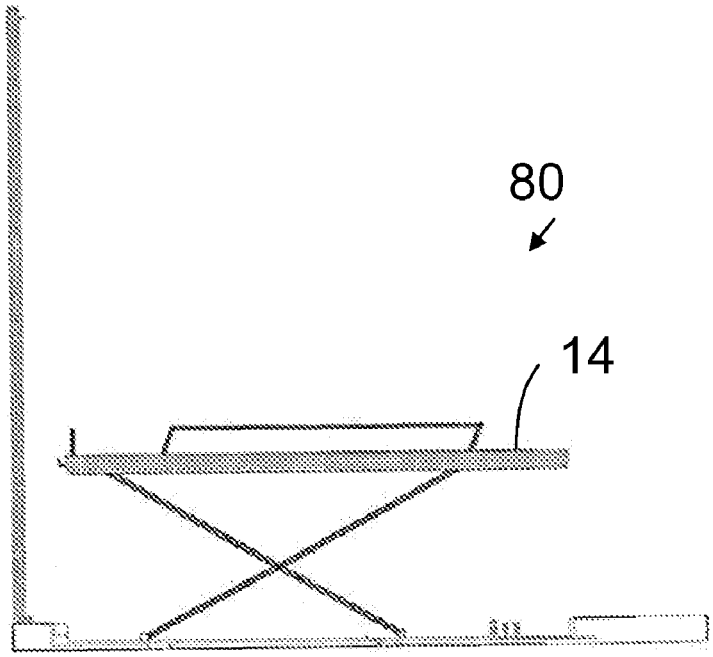
FIG. 6 is a somewhat schematic end view of the medical patient support system of FIG. 3, shown at a second stage of transition from a stowed configuration to a deployed configuration.

FIG. 5 illustrates a first stage transition configuration of the medical patient support system 80 as the work surface 14 is translocated from the stowed configuration of FIG. 4 to the deployed configuration of FIG. 3. FIG. 6 illustrates a second stage configuration of the medical patient support system 80 in transition between the stowed configuration of FIG. 4 and the deployed configuration of FIG. 3.

Figure 7:
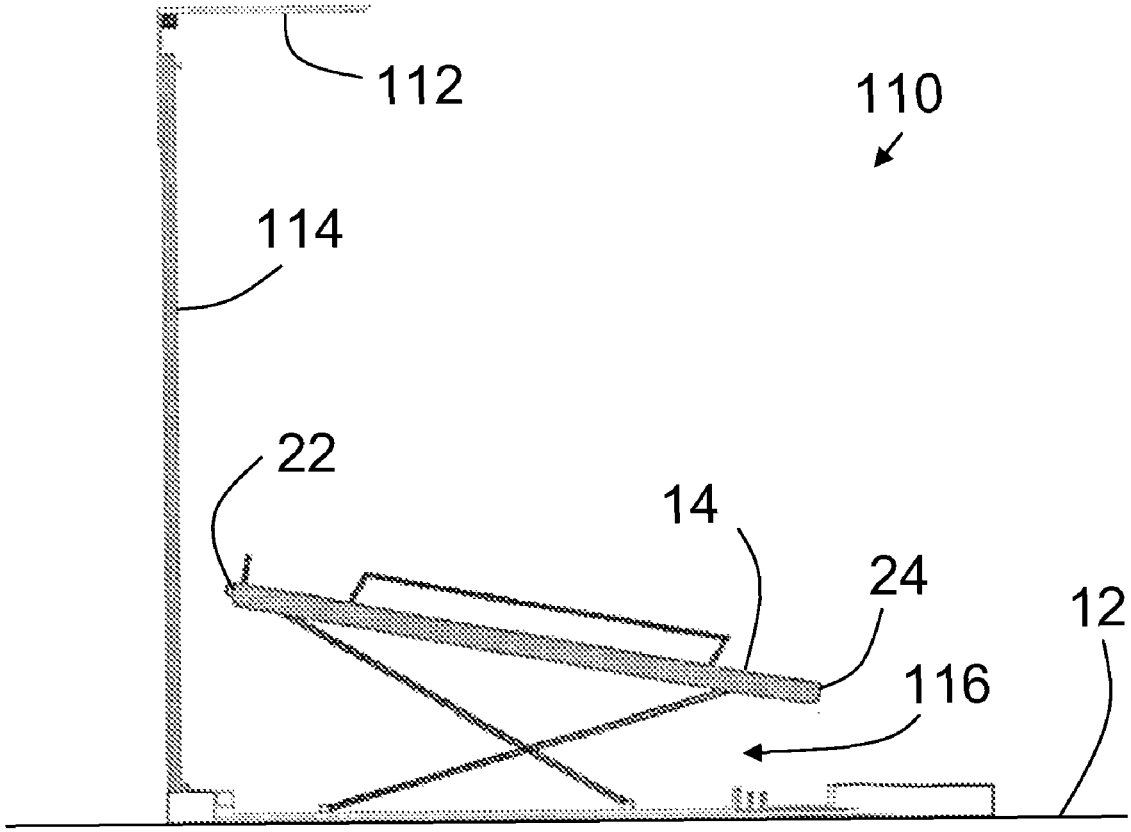
FIG. 7 is a somewhat schematic end view of an alternative embodiment of a medical patient support system.

FIG. 7 illustrates a further embodiment of a medical patient support system 110, shown in its deployed configuration on the floor 12. The medical patient support system 110 is an example of a support platform. The medical patient support system 110 includes a hanger assembly 112 installed on a cover 114. The medical patient support system 110 further includes a bracing system 116 that is configured to dispose the work surface 14 in an orientation that is laterally inclined relative to the floor 12 in the deployed configuration, such that the first side 22 is higher than the second side 24. Alternatively, the bracing system 116 may be configured to laterally incline the work surface 14 in an orientation such that the second side 24 is higher than the first side 22. Such configurations may be helpful in treating a medical patient. In an alternative embodiment the bracing system 116 may configured to dispose the work surface 14 in an orientation that is longitudinally inclined relative to the floor 12 such that the first end 16 (FIG. 1) is higher or lower than the second end 18 (FIG. 1). Such configurations may be helpful to provide patient comfort.

Figure 8:
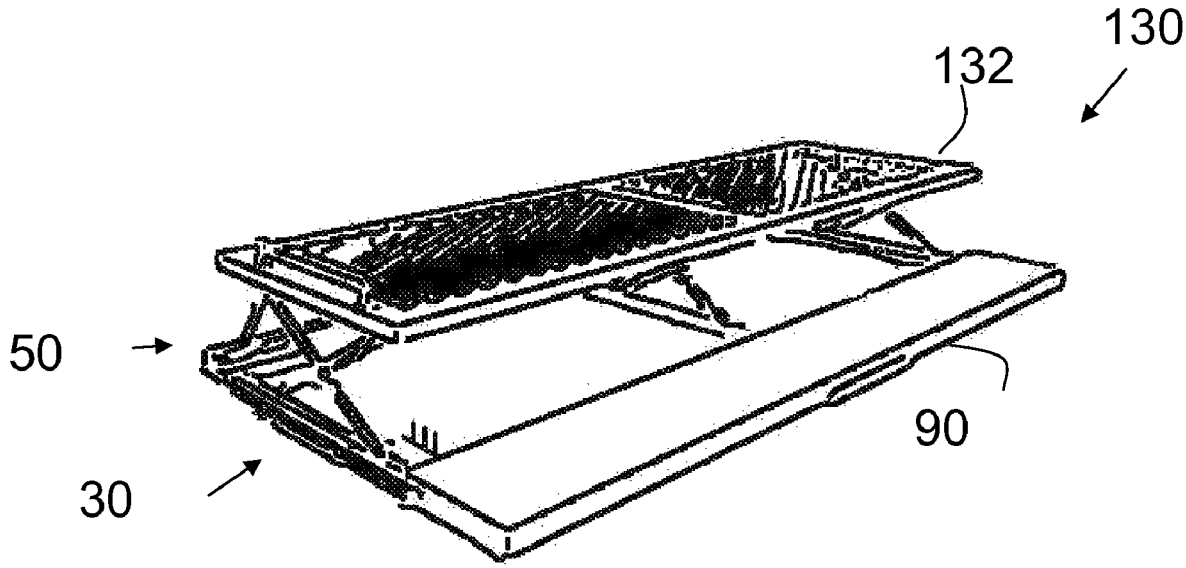
FIG. 8 is a somewhat schematic perspective view of an alternate embodiment of a medical patient support system in a deployed configuration.
Figure 9:
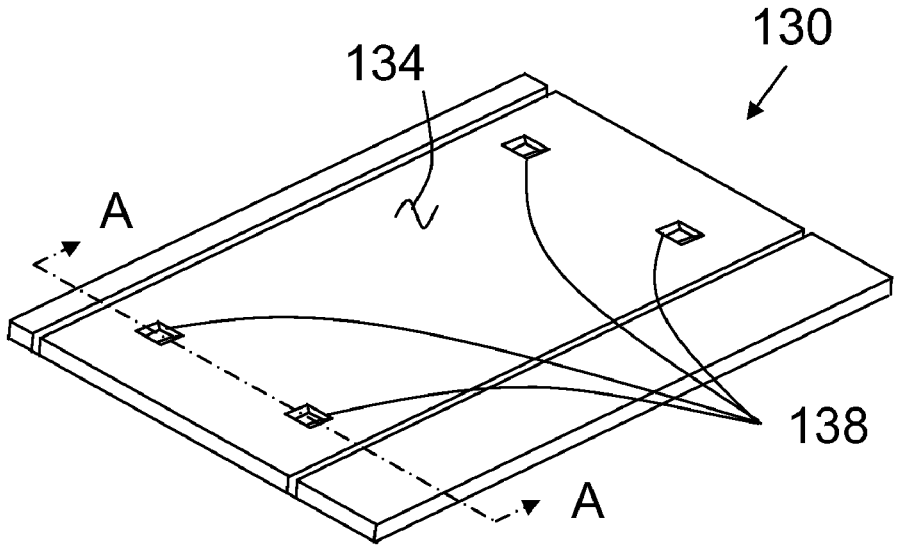
FIG. 9 is a somewhat schematic perspective view of the medical patient support system of FIG. 8 in a stowed configuration.
Figure 10:
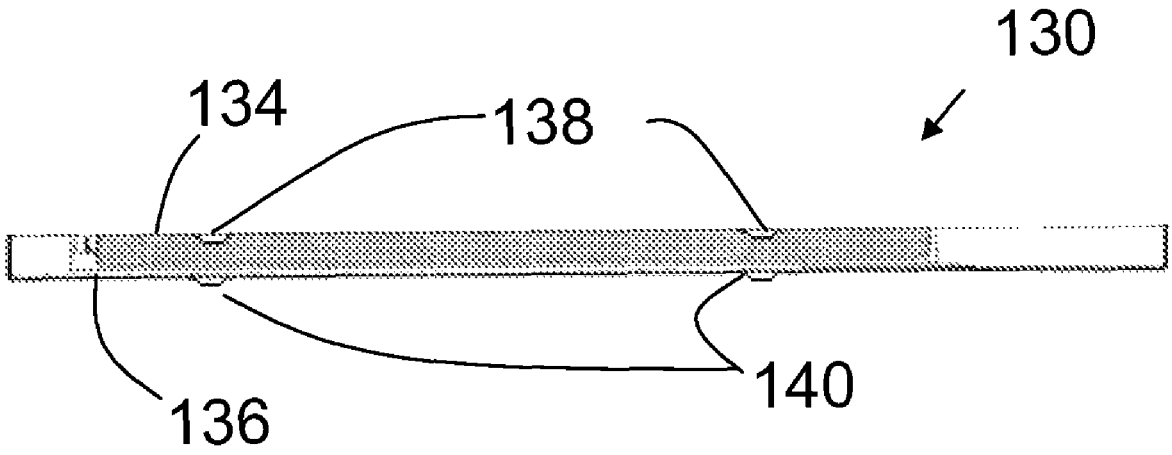
FIG. 10 is a somewhat schematic end view of the medical patient support system of FIG. 9, shown in a stowed configuration.

FIGS. 8-10 illustrate a further embodiment of a medical patient support system 130 which also is an example of a support platform. FIG. 8 illustrates the medical patient support system 130 in the deployed configuration and FIGS. 9 and 10 illustrate the medical patient support system 130 in the stowed configuration. The medical patient support system 130 includes a work surface 132 that is engaged with the previously-described base 30 through the previously-described foldable bracing system 50. In FIG. 9 the medical patient support system 130 is shown to have a substantially flat top surface 134 and in FIG. 10 the medical support system 130 is shown to have a substantially flat bottom surface 136. The top surface 134 has a pattern of indentations 138 and the bottom surface 136 has a pattern of protrusions 140. The top surface 134 and the bottom surface 136 have topographies that are conformed to each other to facilitate stacking multiple medical patient support systems 130 for storage. That is, the pattern of indentations 138 on the top surface 134 and the pattern of protrusions 140 on the bottom surface 136 are spatially matched to help maintain alignment of the medical patient support systems 130 as they are stacked for storage.

In summary, embodiments disclosed herein provide various configurations of medical patient support systems. It should be noted that while the embodiments of the medical patient support systems 10, 80, 110, and 130 described herein are configured primarily for use in transporting, confining, or conducting medical procedures on medical patients, it is to be appreciated that these systems may be used as general-purpose support platforms for such purposes as storing or distributing food and medical supplies, providing eating or sleeping space for emergency personnel, and so forth.

The foregoing descriptions of embodiments have been presented for purposes of illustration and exposition. They are not intended to be exhaustive or to limit the invention to the precise forms disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A support platform operable to be configured in a stowed configuration and a deployed configuration on a floor, the support platform comprising:

a work surface having a lateral extent;

a base comprising a plurality of frame members disposed proximal to the work surface in the stowed configuration and disposed distal from the work surface in the deployed configuration;

a bracing system having a plurality of foldable braces disposed substantially parallel to the lateral extent of the work surface, each brace engaged with the work surface and engaged with the base, wherein at least a portion of at least one brace is disposed inside at least a portion of one of the frame members in the stowed configuration, and wherein the bracing system is configured for translocating the work surface in transitioning between the stowed and deployed configurations and for supporting the work surface at a position distal from the base in the deployed configuration; and a substantially flat cover engaged with a longitudinal frame member by a hinge, the cover having a top surface wherein the top surface is substantially entirely parallel to the floor and adjacent the base in the stowed configuration and is substantially perpendicular to the floor in the deployed configuration.

2. The support platform of claim 1 further comprising a medical service utility manifold engaged with the base wherein the medical service utility manifold is disposed proximal to the work surface when the support platform is configured in the stowed configuration and the medical service utility manifold is disposed distal from the work surface when the support platform is disposed in the deployed configuration.

3. The support platform of claim 1 wherein the base rests on a floor and the support platform further comprises an access platform having a ledge bottom surface that rests on the floor.

4. The support platform of claim 3 further comprising a medical service utility manifold engaged with the base wherein the medical service utility manifold is disposed proximal to the work surface when the support platform is configured in the stowed configuration and the medical service utility manifold is disposed distal from the work surface when the support platform is disposed in the deployed configuration.

5. The support platform of claim 1 wherein the bracing system is configured to dispose the work surface in an orientation that is laterally inclined relative to the floor when the support platform is in the deployed configuration.

6. The support platform of claim 5 further comprising a medical service utility manifold engaged with the base wherein the medical service utility manifold is disposed proximal to the work surface when the support platform is configured in the stowed configuration and the medical service utility manifold is disposed distal from the work surface when the support platform is disposed in the deployed configuration.

7. The support platform of claim 1 wherein the base further comprises an access platform and wherein the bracing system is configured to dispose the work surface in an orientation that is laterally inclined relative to the floor when the support platform is in the deployed configuration.

8. The support platform of claim 1 where in the stowed configuration of the support platform the support platform has a top surface and a bottom surface and substantially the entire top surface is a first flat planar surface and substantially the entire bottom surface is a second flat planar surface that rests on the floor.

9. A support platform operable to be configured in a stowed configuration and a deployed configuration on a floor, the support platform comprising:

a work surface including a first end, a second end, a first side, and a second side, wherein the first end and the second end are substantially parallel with one another, wherein the first side and the second side are substantially parallel with one another, and wherein the first side is higher than the second side when the work surface is in an orientation that is inclined relative to the floor in the deployed configuration;

a base; and a bracing system engaged with the work surface and engaged with the base for translocation of the work surface to a position proximal to the base in the stowed configuration and for translocation of the work surface to a position distal from the base in the deployed configuration, and wherein the bracing system comprises a plurality of braces each formed as X-members having a pair of fixed-length legs disposable at variable crossing angles to each other, wherein the bracing system is configured to dispose the work surface in an orientation that is inclined relative to the floor in the deployed configuration by varying the crossing angles of the legs.

10. The support platform of claim 9 further comprising a medical service utility manifold engaged with the base wherein the medical service utility manifold is disposed proximal to the work surface when the support platform is configured in the stowed configuration and the medical service utility manifold is disposed distal from the work surface when the support platform is disposed in the deployed configuration.

11. The support platform of claim 9 wherein the base is disposed adjacent floor and the support platform comprises a cover engaged with a longitudinal frame member by a hinge, wherein the cover has a top surface and the top surface is substantially perpendicular to the floor when the support platform is in the deployed configuration.

12. The support platform of claim 9 where in the stowed configuration of the support platform the support platform has a top surface and a bottom surface and substantially the entire top surface is a first flat planar surface and substantially the entire bottom surface is a second flat planar surface that rests on the floor.

* * * * *